United States Patent [19]

McNally et al.

[11] Patent Number: 5,026,056

[45] Date of Patent: Jun. 25, 1991

[54] WEIGHT-BALANCED GOLF CLUB SET

[75] Inventors: Robert F. McNally, Hinsdale; John B. Hoeflich, Arlington Heights, both of Ill.

[73] Assignee: Tommy Armour Golf Company, Morton Grove, Ill.

[21] Appl. No.: 395,157

[22] Filed: Aug. 17, 1989

Related U.S. Application Data

[63] Continuation of Ser. No. 96,731, Sep. 15, 1987, abandoned.

[51] Int. Cl.[5] ..... A63B 53/04

[52] U.S. Cl. ..... 273/77 A; 273/167 F; 273/169

[58] Field of Search ..... 273/77 A, 767 F, 167 H, 273/169, 171, 172

[56] References Cited

U.S. PATENT DOCUMENTS

| | | | |
|---|---|---|---|
| D. 234,963 | 4/1975 | Hirata | D34/5 |
| D. 239,964 | 5/1976 | Wilson | D34/5 |
| D. 240,841 | 8/1976 | Solheim | D34/5 |
| D. 244,703 | 6/1977 | Guzzle et al. | D34/5 |
| D. 247,383 | 2/1978 | Adkins | D34/5 |
| D. 256,264 | 8/1980 | Solheim | D21/220 |
| D. 265,494 | 7/1982 | Kobayashi | D21/220 |
| D. 267,965 | 2/1983 | Kobayashi | D21/220 |
| D. 268,775 | 4/1983 | Pace | D21/220 |
| D. 269,101 | 5/1983 | Reymann, Jr. et al. | D21/220 |
| D. 276,644 | 12/1984 | Solheim | D21/220 |
| 1,642,462 | 10/1925 | Reach . | |
| 1,917,774 | 10/1932 | Ogg et al. . | |
| 2,846,228 | 10/1955 | Reach | 273/169 |
| 3,059,926 | 10/1962 | Johnstone | 273/77 A |
| 3,220,733 | 11/1965 | Saleeby | 273/171 |
| 3,250,536 | 5/1966 | Moser | 273/167 F |
| 3,655,188 | 4/1972 | Solheim | 273/77 |
| 3,749,408 | 7/1973 | Mills | 273/171 |
| 3,751,035 | 8/1973 | Lockwood | 273/77 |
| 3,814,437 | 6/1974 | Winquist | 273/167 |
| 3,845,960 | 11/1974 | Thompson | 273/77 A X |
| 3,897,065 | 7/1975 | Solheim | 273/167 |
| 4,200,286 | 4/1980 | Bennett | 273/167 F X |
| 4,322,083 | 4/1982 | Imai | 273/167 F |
| 4,325,553 | 4/1982 | Taylor | 273/167 F |
| 4,326,326 | 4/1982 | MacDonald | 29/428 |
| 4,420,156 | 12/1983 | Campau | 273/77 |
| 4,621,813 | 11/1986 | Solheim | 273/77 |
| 4,655,459 | 4/1987 | Antonious | 273/167 H |
| 4,674,746 | 6/1987 | Benoit | 273/81 |
| 4,679,791 | 7/1987 | Hull | 273/77 |
| 4,715,601 | 12/1987 | Lamanna | 273/169 X |
| 4,802,672 | 2/1989 | Long | 273/169 X |
| 4,826,172 | 5/1989 | Antonious | 273/169 |
| 4,919,430 | 4/1980 | Antonious | 273/169 |
| 4,919,431 | 4/1990 | Antonious | 273/169 |

OTHER PUBLICATIONS

Golf Digest, Feb. 1988, p. 51.

Commercial advertisement of Tommy Armour Golf Company, assignee of subject application re "T-Line (List continued on next page.)

*Primary Examiner*—Carl D. Price

[57] ABSTRACT

A correlated set of golf clubs of the iron type is disclosed in which each club head has a cavity formed in the back surface thereof with specially configured weight pads formed integrally within the back cavity. The weight pads are so configured and positioned within the confines of the back cavity as to create desired heel-toe balancing of each club head wherein each club head's center of gravity physically centered, both horizontally and vertically of the club head, behind the visually-perceived optimal striking point. i.e., the apparent visual center of percussion, of the golf club's striking face relative to the golf ball at address. In the preferred embodiment the configured weight pads are so varied in size and position throughout the set of correlated golf clubs heads as to consistently maintain, for each head, the club head's center of gravity directly behind and in alignment with the club's apparent visual center of percussion.

14 Claims, 3 Drawing Sheets

OTHER PUBLICATIONS

Designer Model" iron clubs.

Commerical ddvertisement of Spalding's "Executive" clubs.

Commerical advertisement from 1970's *Golf Digest U.K.* Magazine of Ryder Manufacturing Company, of Scotland for "Graduate" clubs.

Pages 126 & 127 from 1/78 "Golf Digest" Magazine and also a commercial advertisement of the "Concept" clubs of PGA Victor.

Copy of portions of Acushnet's 1979 catalog re "Titleist Lite 100" clubs.

Canadian patent application on behalf of PGA Victor, which is an English counterpart of the corresponding Japanese Appln. No. 132396/77 (abandoned).

Advertising photograph of the "Concept 2" irons of Tommy Armour Golf Company.

Advertisement in "Golf" Magazine of the MacGregor Golf Company re "CG 1800s" clubs.

Acushnet advertisement for "Titleist DTR" clubs.

Two Ram Golf Company brochures for "Laser X2" clubs.

Group of various commercial brochures of Mizuno Golf Company's Altron clubs.

Portion of a commercial brochure of Beauwood "Passage RE" irons.

Page 77 of "Golf" Magazine advertisement of Daiwa Golf Company's "Hi-Trac" irons.

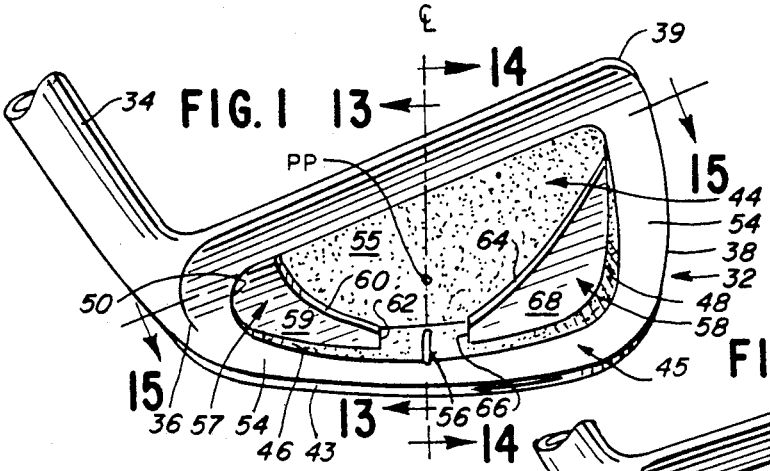
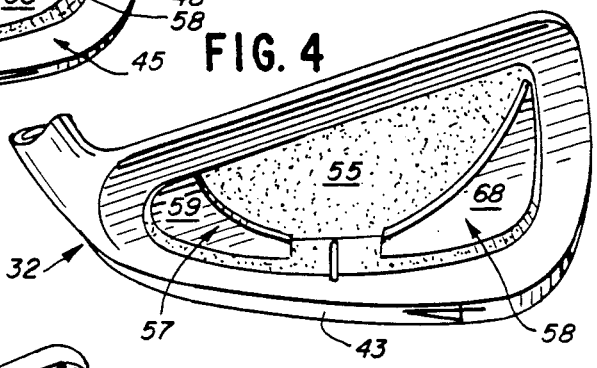
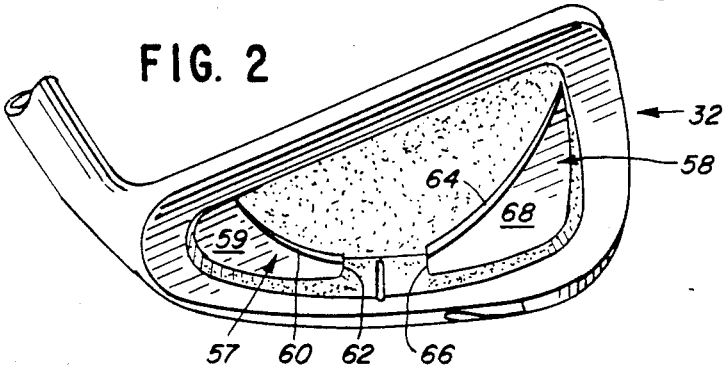
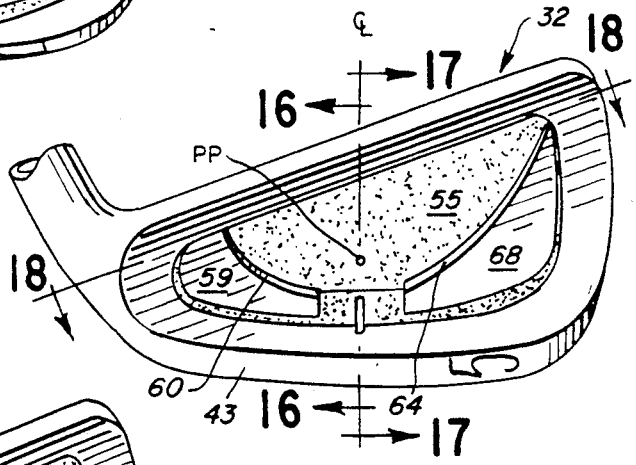
FIG. 5
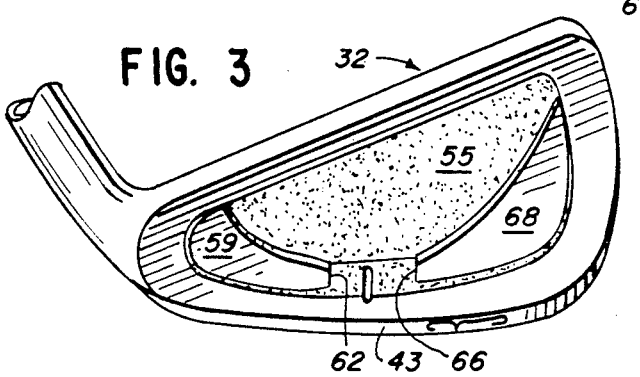

FIG. 6
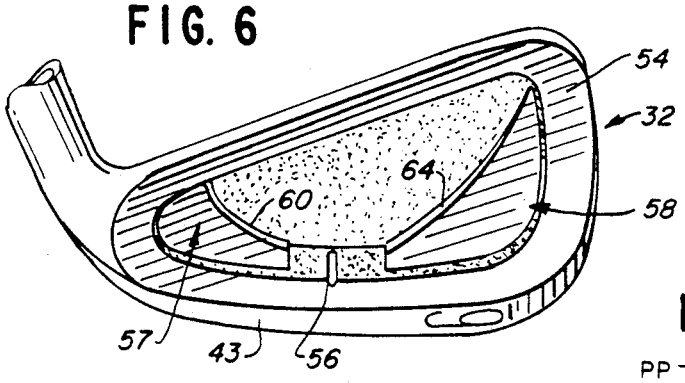
FIG. 9
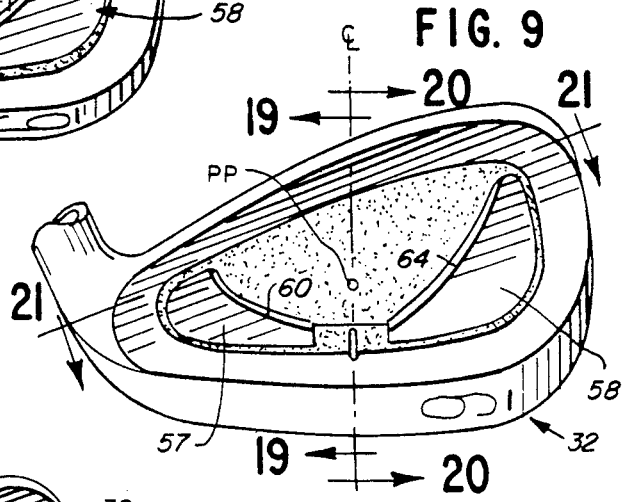
FIG. 7
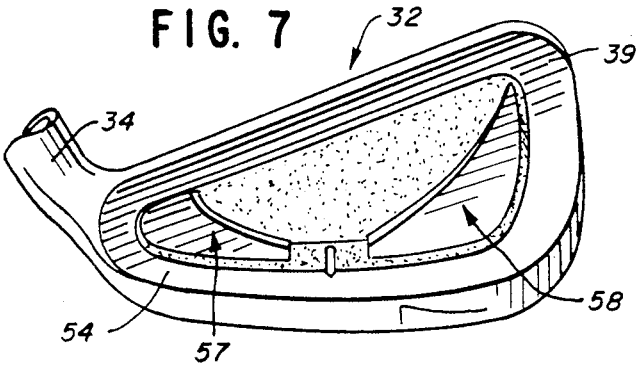
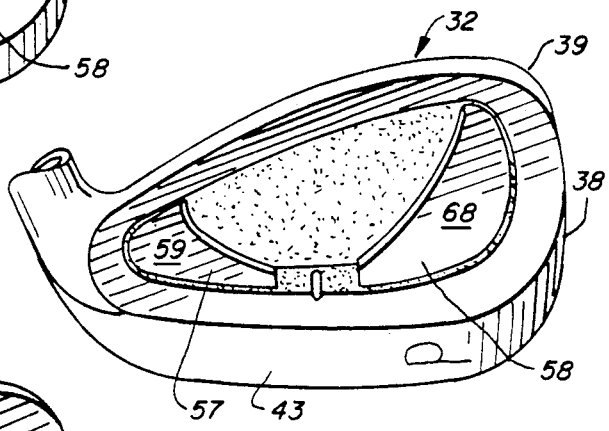
FIG. 10
FIG. 8
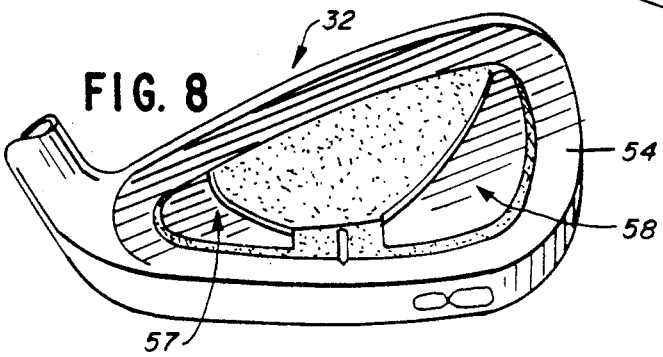

WEIGHT-BALANCED GOLF CLUB SET

This application is a continuation of application Ser. No. 096,731, filed Sept. 15, 1987, now abandoned.

BACKGROUND OF THE INVENTION

1. Field of the Invention

This invention relates generally to golf clubs of the iron type, and more particularly to iron club heads having integral weight pads within a back cavity for re-distributing weight across the back thereof.

2. Description of the Prior Art

There have been many prior attempts to re-distribute weight across the back of a golf club head, and for various reasons. One attempt has been the use of cavities formed in the back of iron club heads to provide so-called "perimeter weighting". This would supposedly allow the club head, during impact with a golf ball, to tend to resist rotation about the point of impact by any undesired torques set up if the ball were hit offcenter, i.e., other than at the desired percussion point. However, use of a back cavity without properly re-distributing on the club head the weight removed from the cavity area did not necessarily achieve maximum distance for the ball or always assure proper flight alignment of the ball even for offcenter hits.

Another prior art attempt was to re-distribute weight across the back surface of an iron club head by progressively adding more weight to one side or the other of the club head's apparent visual percussion point. The intention here was to move the club head's center of gravity more towards the heel or toe as desired depending on the loft of a particular club. This was intended to set up torsional forces to the club head upon impacting the ball so as to overcome a high-handicapper's or amateur golfer's tendency to improperly swing iron clubs of certain lofts through the ball at impact.

SUMMARY OF THE INVENTION

The present invention overcomes the deficiencies of the above-described iron clubs by providing a set of correlated golf club irons having a cavity formed in the back thereof with integrally-formed, specially-configured and specially-positioned weight pads on the cavity walls. The weight pads are operable to place the club head's actual center of gravity, i.e., weight centroid, consistently throughout the club set directly aligned with the visually-perceived optimal striking point, i.e., the apparent visual center of percussion, of each club face. Typically, a golfer visually perceives the optimal striking point, with respect to many designs of iron golf clubs where the scoring lines are arranged horizontally across the club face, to be located on a generally vertical line lying midway between the respective ends of the longest scoring lines.

This feature provides a toe-heel balanced, perimeter-weighted club head in which the club's exact weight centroid is maintained directly in line with the club's apparent visual center of percussion, thereby avoiding the creation of unwanted torques in the club head upon impact with the ball, such as occur when the club's center of gravity is not directly behind the apparent visual center of percussion. Thus, use of the present invention minimizes any unwanted deviations in the flight path of a properly hit ball.

To provide such a correlated set of iron club heads, the desired apparent visual center of percussion of each club is determined. Then the club head's center of gravity is determined once a back cavity has been formed. Finally, the present invention's weight pads are sized, adjusted and integrally positioned within each head's back cavity so as to place the club head's center of gravity directly behind the desired apparent visual center of percussion.

In the preferred embodiment, the shape of the back cavity is substantially uniform throughout the correlated set of iron club heads. This is so, regardless of whether a particular iron club is of a more high-toe profile or of a more traditional or rounded toe profile. Additionally, the weight pads themselves are of substantial uniform shape. However, their relative thickness and height, i.e., their respective sizes, are varied throughout the set of correlated clubs as needed to achieve the goal of continuously maintaining, in each club in the set, the club head's center of gravity directly behind the club's apparent visual center of percussion.

Further, by using weight pads for re-distributing, i.e., incrementally shifting, weight within the back cavity of a perimeter-weighted iron club, the center of gravity of each club can be maintained not only in a horizontal direction along the club's face on the plane containing the club's apparent visual center of percussion, but also in a vertical direction with that percussion point.

Therefore, it is an object of the present invention to provide a correlated set of iron golf clubs in which weight re-distribution means are provided within the club head's back cavity to positionally maintain, throughout the correlated set, each club's center of gravity directly behind the club's apparent visual percussion point.

It is a further object of the present invention to provide iron golf clubs having back cavities with integrally-formed weight pads for incrementally re-distributing the weight within the back cavities, which weight pads are of substantially uniform shape and further are so positionally varied within the back cavities as to maintain each club's center of gravity behind that club's apparent visual percussion point regardless of the loft of the club or the club's overall profile.

It is yet a further object of the present invention to provide a back cavity type golf club iron head which has weight pad means which are so positionally placed and configured within the back cavity as to create a substantially equalized toe-heel balanced, perimeter-weighted iron club head.

The means by which the foregoing and other objects of the present invention are accomplished and the manner of their accomplishment will be readily understood from the following specification upon reference to the accompanying drawings, in which:

FIGS. 1 through 10 are rear elevational views of the heads of a correlated set of golf club irons, showing an embodiment of the present invention and successively illustrating the set's clubs numbered 1 through 9 and a pitching wedge (P);

Figure 16:
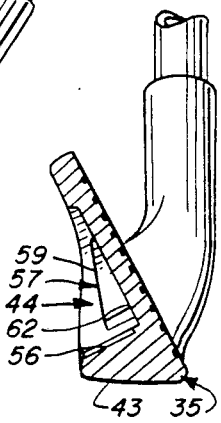
Figure 17:
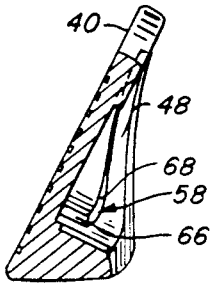
Figure 13:
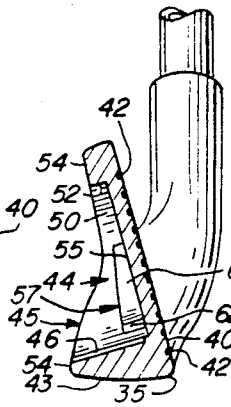
Figure 14:
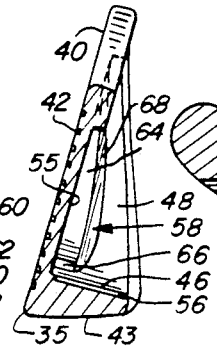
Figure 18:
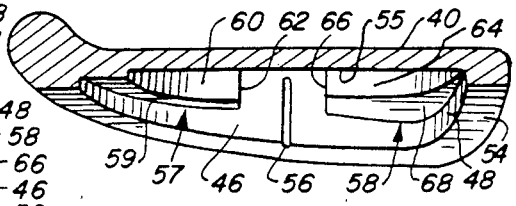
Figure 15:
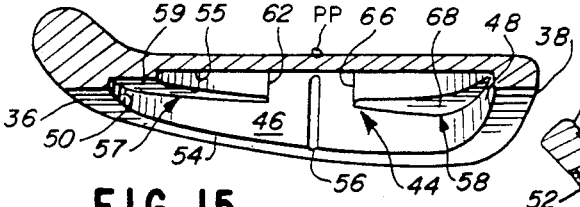
Figure 19:
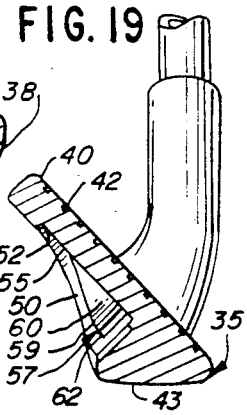
Figure 20:
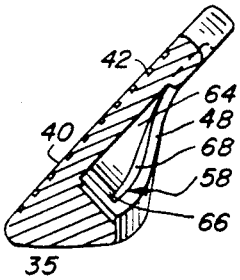
Figure 22:
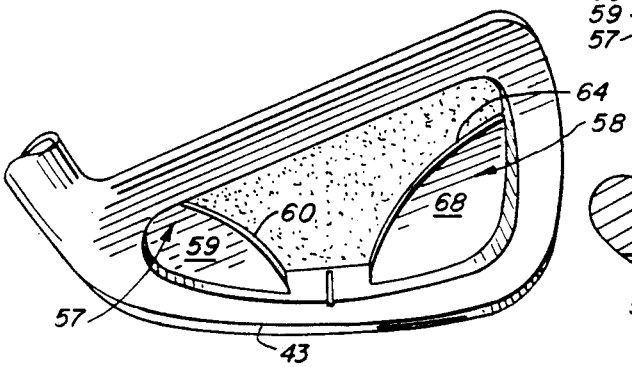
Figure 21:
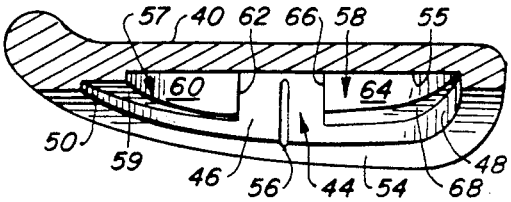

FIGS. 13 and 14 are vertical sections through the head of the No. 1 iron taken approximately on the lines 13—13 and 14—14, respectively, of FIG. 1;

FIG. 15 is a substantially horizontal section of the No. 1 head taken substantially along lines 15—15 of FIG. 1;

FIGS. 16 and 17 are vertical sections through the head of the No. 5 iron taken approximately on the lines 16—16, 17—17, respectively, of FIG. 5;

FIG. 18 is a substantially horizontal section of the No. 5 iron head taken substantially along line 18—18 of FIG. 5;

FIGS. 19 and 20 are vertical sections through the head of the No. 9 iron taken substantially along lines 19—19 and 20—20, respectively of FIG. 9;

FIG. 21 is a substantially horizontal section of the No. 9 iron head taken substantially along lines 21—21 of FIG. 9; and FIG. 22 is a rear elevational view of a No. 1 iron showing an alternate embodiment of the weight pad structure of the present invention.

DESCRIPTION OF THE PREFERRED EMBODIMENT

Figure 11:
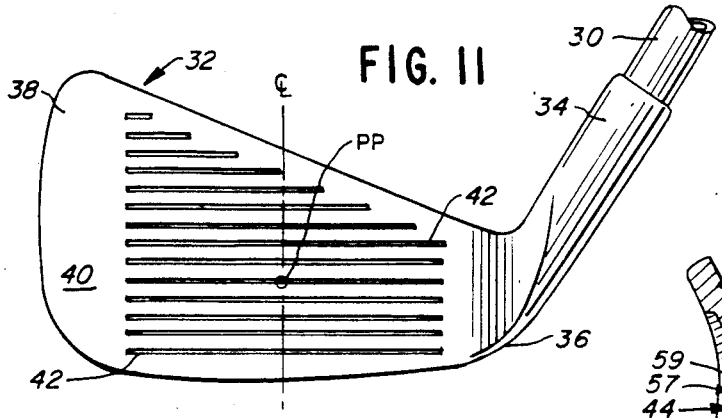
FIG. 11 is a front elevational view of the No. 1 club of FIG. 1, with the shaft broken away just above the hosel.
Figure 12:
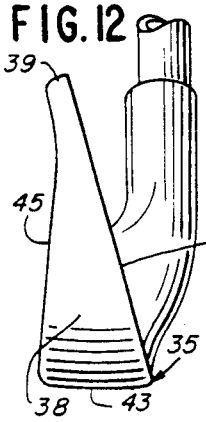
FIG. 12 is a toe end elevational view of the No. 1 club as seen from the left of FIG. 11.

Having reference to the drawings, wherein like reference numerals indicate corresponding elements, there is shown in FIGS. 1, 11, and 12, an illustration of the No. 1 iron of a correlated set of golf clubs made in accordance with the present invention, which iron comprises a shaft 30, with only the lower end thereof being illustrated (FIG. 11), and a head indicated generally by reference numeral 32. Club head 32 also has a hosel 34 formed integrally therewith and connected in the usual manner to the lower end of the shaft 30, as well as a heel portion 36 and a toe portion 38. The head 32 also has a forward planar striking face 40 extending between the heel portion 36 and toe portion 38 lengthwise outwardly from the hosel 34, which striking face 40 slopes upwardly and rearwardly at an acute loft angle with respect to a vertical plane through the lower leading edge 35 (see FIG. 12) of the club face 40. Such acute loft angle can be seen in FIG. 12 for the No. 1 club, as well as differing loft angles for the No. 5 iron as shown in FIG. 16 and for the No. 9 iron as shown in FIG. 19. As used herein, the loft angle of a club head is the angle which the face of the club head makes with a vertical line at the point of impact of the club with the ball when the club head is in the ideal position for the impact to take place.

The striking face 40 is preferably scored along parallel horizontal lines 42 (see FIG. 11). The particular club face design of the club head shown in FIG. 11 is not important to this invention. Further, while an in-hosel shaft mounting is illustrated in FIG. 11, the present invention is equally applicable to an over-hosel connection of shaft 30 to hosel 34.

Referring to FIGS. 1-10, rear elevational views of the various heads 32 of the set of correlated irons of the present invention are shown, as distinct from the front elevational view of the No. 1 iron as shown in FIG. 11. FIG. 1 illustrates the back of a No. 1 iron of FIG. 11, while the remaining FIGS. 2-10 show, respectively, the backs of iron Nos. 2-9 and a pitching wedge (P), with the identifying club numbers inscribed for convenience on the soles 43 of the club heads.

Referring specifically to FIG. 1, it will be seen that club head 32 has a cavity, generally described by reference numeral 44, formed in the rear face 45 thereof. The cavity 44 has a lower generally horizontal surface portion 46, a right side generally vertical surface portion 48, a left side generally vertical surface portion 50, an upper generally horizontal surface portion 52, and a rear cavity wall 55 (see FIGS. 1 and 13).

It will be seen that throughout the correlated set of irons of FIGS. 1-10, the general shape and proportional size of back cavity 44 is consistent in each of the iron Nos. 1-7, and, while they still are of a generally similar shape, the cavities 44 for the No. 8 iron through pitching wedge (P) are somewhat increased in size due to the somewhat larger head size of the No. 8 iron through wedge (P). Further, each such cavity 44 is outlined by a so-called back frame area 54 which constitutes and outlines the extreme rear surface 45 of the club head 32.

A center groove 56 is formed in the lower cavity surface 46 along what is called the club centerline (c/1). The club's centerline (c/1) lies in a vertical plane through the club head 32 and includes the ideal point at the center of the striking face 40 where the golf ball is to be impacted to produce the ideal shot resulting in the greatest distance; this striking point is also called the club's apparent visual center of percussion or percussion point, as identified by reference letters PP. It will be understood that percussion point (PP) is purposely selected to be on the optical and physical center of the striking face 40 of the club head 32, as would be perceived by a golfer holding the club head 32 in the address position.

To achieve the present invention's goal of positioning each club's actual center of gravity, i.e., the club head's weight centroid, directly behind and in vertical alignment with the optical and physical center of the club face, i.e., the club head's percussion point (PP), special weight re-distribution means are utilized within the back cavity 44. In the preferred embodiment, such as shown in FIG. 1, the weight re-distribution means takes the form of a pair of weight pads, generally indicated by reference numeral 57 for the left weight pad and numeral 58 for the right weight pad.

As seen in FIG. 1, the left weight pad 57 is so configured as to have a sloping front wall 59, a generally arcuate-shaped free wall 60 and a free end wall or step wall 62. The left weight pad 57 is integrally joined with and is formed as a part of the back cavity 44, i.e., the various walls of left weight pad 57 respectively smoothly blend into lower cavity surface 46, left cavity vertical surface 50, and upper cavity surface 52. In other words, the left weight pad 57 is so integrally formed with and superimposed into the lower left corner of the back cavity 44 (see FIG. 1) that the structure of left weight pad 57 converges into the cavity wall surfaces 46, 50 and 52.

Further, as best seen in FIG. 13, the left weight pad 57 is so configured that it tapers in a vertical direction. That is, the thinner, upper end of left pad 57 converges into upper cavity surface 52, while the lower end of weight pad 57, including its free end wall or step wall 62, is somewhat thicker at the point it converges into the lower cavity surface 46.

The right weight pad 58 is similarly constructed as left pad 57, i.e. it is also integrally formed within the back cavity 44 and has certain of its walls similarly converging into various back cavity surfaces. The right weight pad 58 has an upper, generally arcuate-shaped free wall 64, a step wall 66, and a front sloping wall 68. Right weight pad 58, however, at least for the No. 1 iron as seen in FIGS. 1 and 4, has its upper tapered end converge into the upper portion of the cavity side wall 48; this is in contrast to the upper tapered end of left weight pad 57 which converges into the top cavity wall 52.

It will be seen that the respective upper peripheral surfaces 60, 64 of each of the weight pads 57, 58 is generally arcuate, and more particularly, is preferably a segment of a conic section, such as a segment of a parabola or hyperbola.

The tapered configuration of left and right weight pads 57, 58, and their smooth convergence into the various walls of cavity 44 is further seen in FIG. 15, which is a generally horizontal sectional view taken along lines 15—15 of FIG. 1. Thus, FIG. 15 shows further how the upper tapered end of left weight pad 57 merges into the left cavity surface 50, upper cavity surface 52, and rear cavity wall 55 of back cavity 44. Additionally, FIG. 15 shows how the upper tapered end of right weight pad 58 converges into the right cavity wall 48 and the rear cavity wall 55 of back cavity 44. FIG. 15 also shows how the respective step walls 62, 66 of left and right weight pads 57, 58 terminate in such a fashion along lower cavity wall 46 as to be spaced equidistantly from the centerline groove 56.

Turning to FIGS. 2–10, it will be seen how the respective left and right weight pads 57, 58 progressively change configurations as required through the successively lofted iron club Nos. 2–9 and wedge (P). This progressive change, i.e. incremental shifting of height, thickness, and position for left and right weight pads 57,58 throughout the correlated set of irons, is to help equally re-distribute the weight in each club's back cavity 44 so as to achieve the present invention's goal of having each club's center of gravity positioned directly behind the club head's visually apparent percussion point (PP).

For example, as seen in FIGS. 5, 16, 17, and 18, there is shown the No. 5 iron of the correlated set of golf club irons made in accordance with the present invention. Specifically, as depicted in FIGS. 5 and 16, the left weight pad 57 is seen as being substantially thicker at its free end wall 62, as compared to that of left weight pad 57 of the No. 1 iron depicted in FIGS. 1 and 13. Moreover, the right weight pad 58 of the No. 5 iron as shown in FIGS. 5 and 17 is shown as terminating at a higher location (than the corresponding location as shown for the No. 1 iron in FIGS. 1 and 14) along right cavity wall 48, i.e. it terminates substantially at the upper convergence of the right cavity wall 48 with the upper cavity wall 52. Further, as seen in FIGS. 17 and 18, the step wall 66 of right weight pad 58 for the No. 5 iron is substantially thicker than the corresponding step wall 66 of right weight pad 58 of the No. 1 iron as shown in FIGS. 1 and 14.

Further, as seen in FIG. 18, the overall thickness of the club head's face (as measured between striking surface 40 and rear cavity wall 55) is somewhat thicker in the No. 5 iron than the similar thickness of the face of the No. 1 iron as shown in FIGS. 13 and 15.

There is shown in FIGS. 9, 19, 20, and 21, the configuration of the respective weight pads 57, 58 of the No. 9 iron of the correlated set of clubs made in accordance with the present invention. In FIGS. 9 and 21, it is seen that the right weight pad 58 for this No. 9 iron has been so progressively re-positioned that the upper tapered end of weight pad 58 converges into the upper cavity wall surface 52 of back cavity 44. Consistent with the present invention's steady progression of shape and location of the weight pads 57, 58 throughout the correlated set of clubs, the weight pad 58 for the pitching wedge (P) as shown in FIG. 10, is even in further engagement with the upper cavity wall surface 52.

It will be understood that, through use of the weight pad means of the present invention, the width of the various component sides of the back frame area 54 can vary from club to club within the set, if desired, such as is shown in the preferred embodiment depicted in FIGS. 1–10. However, that back frame area width need not vary from club to club, if so desired, without effecting the ability of the weight re-distribution means of the present invention from successfully operating, as taught herein. Further, the overall shape of the back cavity 44 of each of the clubs in the correlated set is of a generally uniform shape regardless of the specific loft, i.e. club number, of a club in the set.

Preferably, the weight of the iron club heads in a correlated set of golf clubs made in accordance with the present invention should weigh approximately the amounts shown in the following chart:

| Loft by Club Number | Weight in Grams |
|---|---|
| 1 | 230 |
| 2 | 235 |
| 3 | 240 |
| 4 | 245 |
| 5 | 252 |
| 6 | 259 |
| 7 | 266 |
| 8 | 273 |
| 9 | 281 |
| P | 286 |

As seen in FIGS. 1 through 7, the No. 1 irons through No. 7 iron have a consistent height from the upper toe end 39 to the sole 43 of each club head 32. However, for the No. 8 iron through pitching wedge (P), as seen in FIGS. 8–10, the height of the club, as measured from the upper toe end 39 to the sole 43, gets progressively larger. It is to be understood that this is merely a matter of design choice; it is not a feature of the present invention.

The preferred embodiment of a correlated set of irons with weight pad means within the back cavity made in accordance with the present invention can be readily made to the foregoing preferred weight specifications. Nevertheless, the weight pads 57, 58, as shown in the various FIGS. 1–10 can be adjusted, i.e. changed in position and shape, as needed to achieve the goal of the present invention, as well as to accommodate different designs of golf clubs or differing weights of club heads. For example, the weight pad means of the present invention can be used with any design club regardless of whether they have a high toe end design or more traditional, lower toe end design.

It will be seen in the drawings that the length of the iron clubs 32 in tee preferred embodiment, as measured from the left center portion of the heel 36 to the outermost surface area of the toe 38, does not vary from club to club. Thus, the No. 1 iron is the same length as the wedge (P). Nevertheless, so as to accommodate any length of club, the weight pads 57, 58, of the present invention can be adjusted in shape and placement within the back cavity 44 to continuously maintain the club head's center of gravity directly behind the visually-perceived percussion point (PP).

Further, it will be seen in FIGS. 13–14, 16–17, and 19–20, that the respective depth of the back cavity 44, whether measured at the upper cavity surface 52 or the lower cavity surface 46, progressively changes throughout the correlated set of iron clubs. The No. 1 iron has the deepest back cavity 44, while the cavity 44 of the No. 5 iron is intermediate in depth, and the No. 9 iron is substantially the shallowest in depth, except for pitching wedge (P), the depth of which is not shown.

Thus, it can be seen that through use of the variously configured and positioned weight pads 57, 58 respectively in the lower left and right corner areas of the back cavity 44 for each club 32, an equally toe-heel balanced, perimeter-weighted, correlated set of golf club irons can be formed which consistently maintains each club's actual center of gravity behind the optical and physical center of the club's striking face, i.e., visually-perceived percussion point (PP). This is accomplished by using the weight pads to incrementally redistribute weight within the confines of the back cavity 44, in contrast to re-distributing weight at points external to the back cavity area 44, such as was done in prior art club designs. In such prior designs, weight was added in the back frame area, such as by increasing the length or height of the club head's toe end 39, for example.

With the present invention, the maintenance of the club's center of gravity directly behind the club's visually-perceived percussion point (PP) helps to maximize the energy transfer to the ball and minimizes lateral twisting of the club head during impact. These characteristics result in more powerful shots which travel greater distance. with less lateral deviation from the intended line of flight.

It also will be understood that shots hit at a point on the club face other than at the club head's visually-perceived center of percussion (PP) will nevertheless achieve average distance and minimal alignment deviations which are superior in result to shots hit with clubs of prior designs where the respective visually apparent centers of percussion are not aligned with their respective weight centroids.

It will be understood that the center of gravity in the preferred embodiment is always directly behind the visually-perceived percussion point (PP). However, the center of gravity can be moved upwardly or downwardly on the vertical plane containing the percussion point (PP) by simply sculpting, i.e., configuring, the respective weight pads 57, 58 as to have more weight at their upper tapered end portions. For example, to raise the center of gravity, one could converge more of the upper tapered portion of the weight pads into the upper cavity wall 52, as is seen with the weight pads 57, 58 for the pitching wedge (P) (FIG. 10), for example. This can similarly be done in the other so-called "short irons", i.e., Nos. 7–9 clubs, if the center of gravity is desired to be higher up on the club's striking face 40.

Thus, with the present invention, the center of gravity can either be maintained directly behind the visually-perceived percussion point (PP), or if desired, it can be raised or lowered relative to this percussion point (PP), while still being maintained within the vertical plane of this percussion point (PP).

FIG. 22 shows the back cavity 44 for a modified embodiment of a No. 1 iron in which the weight pads 57, 58 are of a modified shape. That is, instead of having free walls 60, 64 which curve in a generally concave shape relative to the upper cavity wall 52 (such as depicted in FIG. 1 for the preferred embodiment), the modified free walls 60, 64 in FIG. 22 curved in a generally convex shape. Nevertheless such modified weight pads 57, 58 in FIG. 22 are still formed integrally to the club head 32 within the lower left and right hand corners of back cavity 44, and their operation as taught herein is not changed.

It will be understood that the respective weight pads 57, 58 for a back cavity-type club head made in accordance with the present invention could take shapes other than as shown in FIGS. 1–10, and 22. For example, such weight re-distribution means formed integrally within a club head's back cavity could take other geometric shapes, such as round pads, square or rectangular pads, conic-shaped pads, and so forth, or not be tapered, all without affecting the advantageous operation of such weight pad structure as taught herein.

From the foregoing, it is believed that those skilled in the art will readily appreciate the unique features and advantages of the present invention over previous types of weight re-distribution structure for correlated sets of iron golf clubs. Further, it is to be understood that while the present invention has been described in relation to a particular preferred and an alternate embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

We claim:

1. An improved correlated set of iron-type golf clubs, in which each club has a head including a front face for striking a golf ball at a percussion point centered on said front face, a heel portion, a toe portion, a sole portion extending generally between said heel and toe portions, and back surface, said back surface having a peripheral back frame forming a single cavity therewithin, the improvement comprising weight re-distribution means formed integrally with each said club head within said back cavity and positioned in said back cavity in abutting relationship to said peripheral back frame respectively along said toe portion and heel portion, said weight re-distribution means for each club within said correlated set comprising two discrete weighting elements presenting stepped pad portions relative to said back cavity, said discrete weighting elements being so configured in size and shape as to locate the center of gravity of the club head substantially in centered alignment with said centered percussion point.

2. The structure of claim 1, wherein each said discrete weighting element has a generally conic segmental contour along the upper periphery thereof.

3. The structure of claim 1, wherein said peripheral back frame has upper and lower walls and said discrete weighting elements are generally tapered in their vertical dimension with a generally thicker base portion and a generally thinner upper portion, said generally thicker base portion being in said abutting relation to said peripheral back frame at said lower wall thereof.

4. The structure of claim 1 wherein said discrete weighting elements are generally concave in shape when viewed in rear elevation.

5. The structure of claim 1, wherein said discrete weighting elements are generally convex in shape when viewed in rear elevation.

6. The structure of claim 1, wherein said stepped pad portions are generally concave in shape when viewed in cross section in a plane normal to said front face of said club.

7. The structure of claim 1, wherein said stepped pad portions are generally convex in shape when viewed in cross section in a plane normal to said front face of said club.

8. A correlated set of golf clubs of the iron-type, each club head including a striking face for impacting a golf ball at a percussion point centered thereon, a heel portion, a toe portion, a sole portion, and a back surface having a back frame portion substantially surrounding a back cavity and having at least a lower wall, the improvement comprising discrete stepped weight pad means formed integrally within said back cavity of each said club head respectively along said toe and heel portions and in abutting relation to said lower wall of said back frame portion, the respective said stepped weight pad means throughout the correlated set of golf clubs being so incrementally re-positioned and changed in size and configuration as needed as to continuously substantially locate for each club within said correlated set, the center of gravity for said club head in centered alignment with said centered percussion point.

9. An improved correlated set of golf clubs of the iron-type, each club having a striking face with a percussion point located centrally thereon, a toe portion, a heel portion, a sole portion, and a rear face with a back cavity formed therewithin surrounded by a back frame, the improvement comprising discrete stepped weight pad means respectively formed integrally within the confines of said back cavity along said respective toe portion and said heel portion in abutting relation to said back frame for incrementally re-distributing weight in each successive club in the correlated set so as to consistently maintain, throughout the correlated set, the center of gravity of each said club head substantially in centered alignment with said centrally located percussion point.

10. An improved correlated set of golf clubs of the iron-type, each club including a club head having a striking face with a percussion point located in the center thereof, a sole portion, toe portion, a heel portion, and a back face including a peripheral back frame member having at least upper and lower walls, and a back cavity formed within the back frame member, the improvement comprising means for positioning the center of gravity of each club head substantially in centered alignment with the said center located percussion point, said positioning means comprising discrete weight pad means formed integrally to said club head within the confines of said back cavity at said respective toe portion and heel portion in abutting relation to at least said lower wall of said back frame member, said weight pad means being progressively changed in location and configuration within the back cavity of each respective said club head within the correlated set as needed to consistently maintain the center of gravity of each said club head in substantial centered alignment with said center located percussion point.

11. An improved correlated set of golf club irons, each having a striking face with a percussion point centered thereon, a toe portion, a heel portion, a sole portion, and a back surface having a peripheral back frame and a back cavity formed therein, the improvement comprising integrally formed material added in discrete stepped portions within the confines of the back cavity of each said club head respectively along said toe portion and said heel portion and in abutting relation to said peripheral back frame for incrementally re-distributing the weight within said back cavity for the purpose of maintaining the center of gravity of each respective club head in centered alignment with said centered percussion point.

12. The structure of claim 11, wherein said integrally-formed material comprises discrete weight pad elements formed integrally within the lower respective portions of said toe and heel portions of said back cavity of each said club head, said discrete weight pad elements being so incrementally changed in position and configuration in said abutting relation to said peripheral back frame as is needed, for each club head within the correlated set, to consistently maintain said center of gravity in substantially centered alignment with said centered percussion point.

13. A golfing iron club comprising a grip-equipped shaft and a club head, said club head including a unitary hosel portion and a head portion, said head portion including a front striking face having a percussion point located in the center thereof, a rear face, a sole, heel and toe portions, said rear face having a single cavity defined by a generally perimetric rearwardly-extending back frame wall, and weight re-distribution means formed integral with said head portion within said cavity in abutting relation to the lower portion of said back frame wall and extending generally vertically therefrom along said toe and heel portions, said weight re-distribution means operable to position the center of gravity of said club head in substantially centered alignment with said center located percussion point.

14. The structure of claim 13, wherein said weight re-distribution means extends generally vertically in tapered thickness from said lower portion of said back frame wall.

* * * * *

UNITED STATES PATENT AND TRADEMARK OFFICE

CERTIFICATE OF CORRECTION

PATENT NO. : 5,026,056

DATED : June 25, 1991

INVENTOR(S) : Robert F. MacNally and John B. Hoeflich

It is certified that error appears in the above-identified patent and that said Letters Patent is hereby corrected as shown below:

On the title page, under item [19], and in item [75]:
Please correct the inventor's name from "McNally" to
--MacNally--

Signed and Sealed this

Third Day of November, 1992

*Attest:*

DOUGLAS B. COMER

*Attesting Officer*

*Acting Commissioner of Patents and Trademarks*